US011858594B2

(12) United States Patent
Belding

(10) Patent No.: US 11,858,594 B2
(45) Date of Patent: Jan. 2, 2024

(54) ANCHOR ASSIST DEVICE

(71) Applicant: Roger William Belding, Glengowrie (AU)

(72) Inventor: Roger William Belding, Glengowrie (AU)

( * ) Notice: Subject to any disclaimer, the term of this patent is extended or adjusted under 35 U.S.C. 154(b) by 303 days.

(21) Appl. No.: 17/435,187

(22) PCT Filed: Aug. 21, 2019

(86) PCT No.: PCT/AU2019/050881

§ 371 (c)(1),
(2) Date: Aug. 31, 2021

(87) PCT Pub. No.: WO2020/220063

PCT Pub. Date: Nov. 5, 2020

(65) Prior Publication Data

US 2022/0144385 A1 May 12, 2022

(30) Foreign Application Priority Data

Apr. 27, 2019 (AU) ..... 2019901425

(51) Int. Cl.
*B63B 21/26* (2006.01)

(52) U.S. Cl.
CPC ..... *B63B 21/26* (2013.01); *B63B 2021/262* (2013.01)

(58) Field of Classification Search
CPC ..... B63B 21/00; B63B 21/24; B63B 21/30; B63B 21/34
USPC ..... 114/294, 295, 301
See application file for complete search history.

(56) References Cited

U.S. PATENT DOCUMENTS 7,082,888 B1 * 8/2006 Al-Sabah ..... B63B 21/243 114/298
2008/0245287 A1 10/2008 Vogan et al.

FOREIGN PATENT DOCUMENTS

EP 1 173 357 B1 8/2004
JP 57-65192 U 4/1982

OTHER PUBLICATIONS

International Preliminary Report on Patentability, issued in PCT/AU2019/050881, dated Nov. 1, 2019.
International Search Report, issued in PCT/AU2019/050881, dated Sep. 13, 2019.
Written Opinion of the International Searching Authority, issued in PCT/AU2019/050881, dated Sep. 13, 2019.

* cited by examiner

*Primary Examiner* — Daniel V Venne
(74) *Attorney, Agent, or Firm* — Birch, Stewart, Kolasch & Birch, LLP

(57) ABSTRACT

An anchor assist device for use with a grappling anchor, the grappling anchor including a shank, a plurality of prongs extending outwardly from a lower end of the shank and an inner portion defined by the lower end of the shank and corresponding lower ends of each of the prongs. The anchor assist device including a plate section having a base end and an opposing ground-engaging end. The base end of the plate section is attached to the inner portion of the grappling anchor, such that the plate section is supported by one or more prongs of the grappling anchor, and the ground-engaging end of the plate section extends outwardly from the inner portion of the grappling anchor to provide increased anchor hold capacity within soft anchoring ground.

20 Claims, 16 Drawing Sheets

ANCHOR ASSIST DEVICE

FIELD OF INVENTION

This invention relates to an anchor assist device for use with a grappling anchor, which is used to improve the anchor's hold capacity when used on soft anchoring grounds, such as sand, rubble, mud or shale.

BACKGROUND

Anchors are devices used to connect a vessel to an anchoring ground or surface, such as the bed of a body of water, etc., to prevent the vessel from drifting due to wind and/or current. This is generally achieved by "hooking" into or onto an anchoring surface. There are a variety of different types of anchors that are structured to serve different purposes depending on the vessel type and the type of anchoring surface or ground. Traditionally, boat anchors are either designed predominantly for use on underwater soft bed anchoring grounds, such as loose gravel, shale, sand or mud, or alternatively, for use on hard or semi-hard bed underwater anchoring grounds, such as reef or rock.

A large portion of watercraft and marine vessels/structures use grappling anchors, which are traditionally formed of a shank with four or more prongs (or tines), and which may also be known as grapnel, reef, rock or wreck type anchors. These types of anchors provide a connection with the anchoring ground through their set of prongs (or tines) with the intent that one or more anchor prong will catch and hold onto a hard or semi-hard underwater ground structure/surface. Therefore, whilst grappling anchors are commonly used and fitted to many vessels and boats, they are predominantly designed for use on hard and semi-hard type anchoring grounds, such as reef and rock beds. This is due to the fact that they exhibit moderate to poor anchor hold capacity when used on underwater soft bed anchoring ground, such as lose gravel, shale, sand or mud. This therefore creates difficulties when a vessel encounters different types of anchoring surfaces.

Present options when anchoring on soft ground with a grappling type anchor include either changing the anchor to one that is more suitable for use on soft ground. However, this is undesirable as this requires the added work of changing the anchor type and needing to have a different anchor type on hand at all times, which is impractical. Alternatively, another option is to frequently reset the grappling anchor when the wind, tide or other event drags the vessel or boat off a selected location, which is also not desirable or practical.

OBJECT OF THE INVENTION

It is an object of the invention to overcome, or at least substantially ameliorate, the disadvantages and shortcomings of the prior art.

Other objects and advantages of the present invention will become apparent from the following description, taken in connection with the accompanying drawings, wherein, by way of illustration and example, certain embodiments of the present invention are disclosed.

SUMMARY OF THE INVENTION

According to the present invention, there is provided an anchor assist device for use with a grappling anchor, the grappling anchor including a shank, a plurality of prongs extending outwardly from a lower end of the shank, and an inner portion defined by the lower end of the shank and corresponding lower ends of each of the prongs, the anchor assist device including:

a plate section having a base end and an opposing ground-engaging end; wherein the base end of the plate section is attached to the inner portion of the grappling anchor, such that the plate section is supported by one or more prongs of the grappling anchor, and the ground-engaging end of the plate section extends outwardly from the inner portion of the grappling anchor.

In preference, the base end of the plate section is welded to the inner portion of the grappling anchor.

In preference, the base end of the plate section is movably coupled to the inner portion of the grappling anchor by way of a coupling means, such that the plate section is able to move from a first position in which the plate section is supported by the one or more of the prongs of the grappling anchor to a second position away from the one or more prongs of the grappling anchor.

In preference, the coupling means includes one or more shackles that movably couple the plate section to the lower end of one or more prongs of the grappling anchor.

In preference, the base end of the plate section is movably coupled to the lower ends of a pair of prongs of the grappling anchor by a pair of shackles.

In preference, the one or more shackles are permanently attached to an underside of the plate section.

In preference, the one or more shackles are welded to the underside of the plate section.

In preference, the one or more shackles are removably attached to an underside of the plate section.

In preference, the shackles are positioned through corresponding holes formed through the base end of the plate section and secured with a plurality of nuts.

In preference, the ground-engaging end of the plate section includes one or more leading edges adapted to penetrate a soft anchoring surface.

In preference, the one or more leading edges are flattened edges.

In preference, the one or more leading edges form a point.

In preference, the plate section is flat.

In preference, the plate section is curved or bent.

In preference, the plate section is an isosceles trapezoid having a pair of sides of equal length, and wherein the leading edge is flat and has a narrower width than the base end of the plate section.

In preference, the anchor assist device further includes a cross member that extends transversely across the plate section and overhangs a first side and a second side of the plate section, such that the cross member may be supported by neighbouring prongs of the grappling anchor.

In preference, the cross member is attached to an underside of the plate section.

In preference, the cross member is welded to an underside of the plate section.

In preference, the cross member is bolted to an underside the plate section.

In preference, the plate section further includes one or more extension pieces that project outwardly from a first side and a second side of the plate section, such that the extension pieces may be supported by neighbouring prongs of the grappling anchor.

The invention when affixed to a parenting grapnel, grappling, or reef anchor provides a plate section with a ground-engaging end that will dig into and provide increased anchor hold capacity within soft anchoring ground, such as loose gravels, shale, sand or mud.

In addition, the anchor assist device of the invention is quick and easy to fit to a grappling anchor and once fitted will provide a wide friction hold area increasing the anchor hold capacity for soft anchoring grounds, such as loose gravels, shale, sand or mud. Also, the anchor assist device when attached to the grappling anchor will have minimal effect on the capability and hold capacity of the grappling anchor when used on hard or semi-hard anchoring ground, such as reef or rocky seabed or riverbed, and as such once attached the invention may optionally stay in-place permanently.

In order to now describe the invention in greater detail a series of preferred embodiments will be presented with the assistance of the following illustrations and accompanying text.

DESCRIPTION OF THE EMBODIMENTS

The following description will describe several embodiments of the present invention. However, it is to be understood that the features illustrated in and described with reference to the drawings are not to be construed as limiting the scope of the invention.

Figure 2:
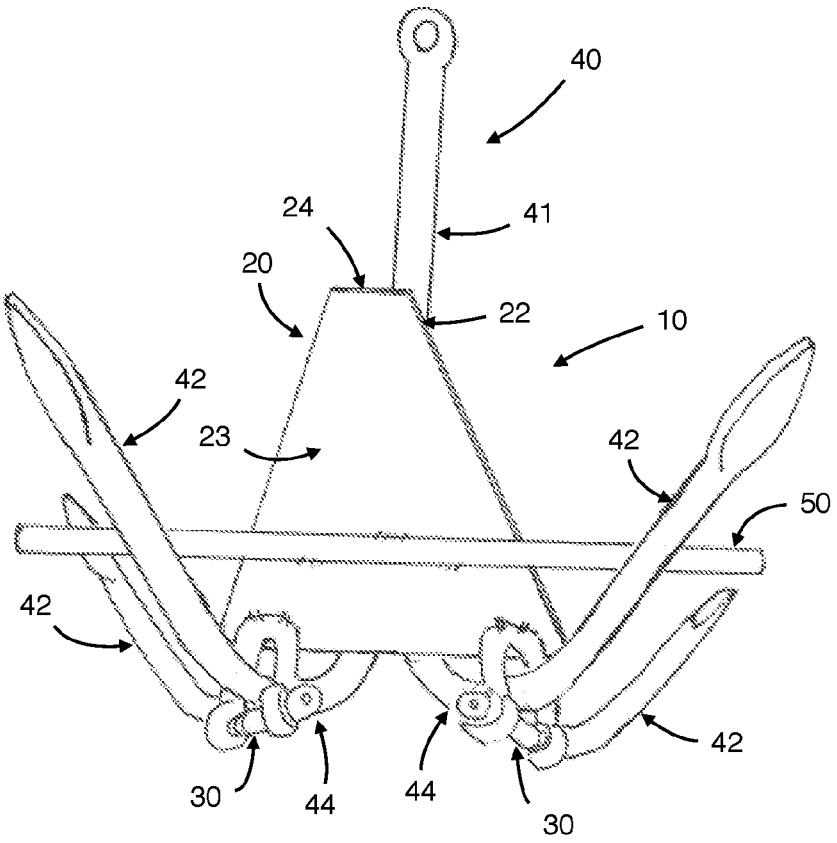
FIG. 2 is a perspective view of the anchor assist device in use with a grappling anchor in a preferred embodiment of the present invention.
Figure 3:
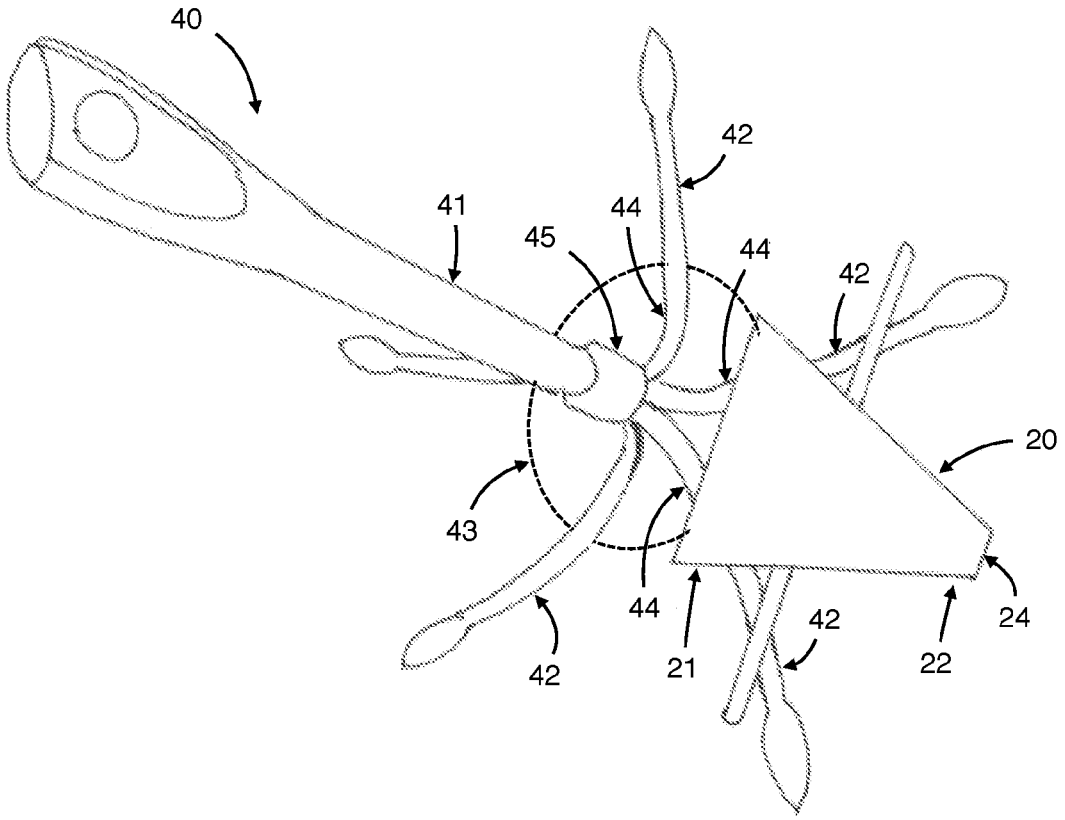
FIG. 3 is a perspective view of the anchor assist device in use with a grappling anchor in a preferred embodiment of the present invention.
Figure 4:
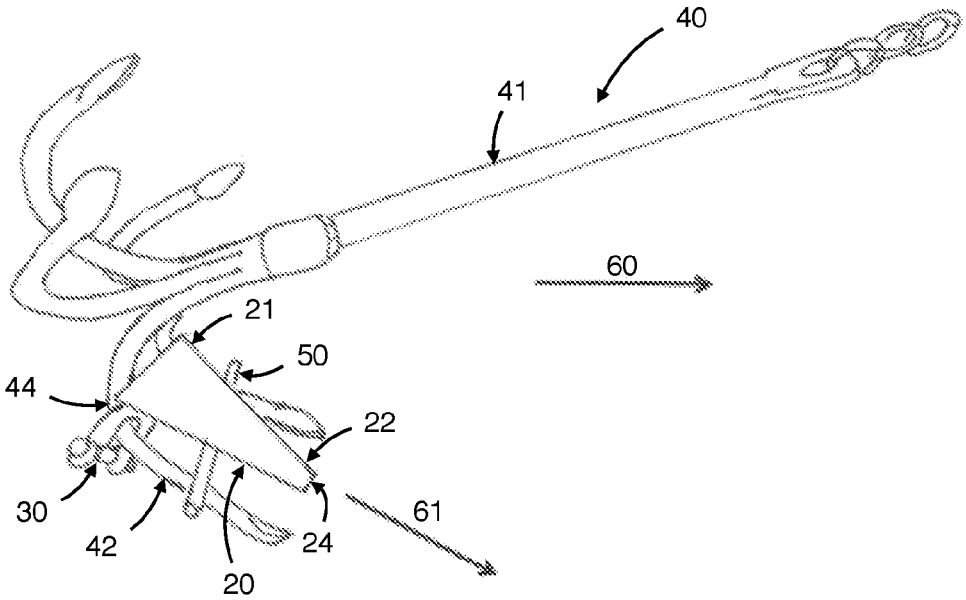
FIG. 4 is a perspective view of the anchor assist device in use with a grappling anchor in a preferred embodiment of the present invention.

The anchor assist device (10) of the present invention is designed for use with a grappling anchor (40), such as that depicted in FIGS. 2 to 4. The term grappling anchor (40) according to the present invention is intended to include any type of anchor that includes a shank (41) and a plurality of prongs (42) that extend outwardly from a lower end (45) of the shank (41), which also includes, but is not limited to, anchors that may also be known by or referred to as grapnel, reef, rock or wreck type anchors. Grappling anchors (40), and other similarly structured anchors, provide a connection with the anchoring ground through their set of a plurality of prongs (42), or tines, wherein one or more anchor prong (42) will catch and hold onto a hard or semi-hard underwater ground structure/surface. Whilst the grappling anchors (40) depicted in the Figures include four or five prongs (42), which are the most common types, the anchor assist device (10) is suitable for a range of grappling type anchors having any number of prongs (42), particularly those having three or more prongs.

More particularly, as per FIG. 2, the grappling anchor (40) shown includes a shank (41) with four or more prongs (42), or tines, that extend outwardly from a lower end (45) of the shank (41). The grappling anchor (40) also includes an inner portion (43), which is defined by the inner region including the lower end (45) of the shank (41) and the lower ends (44) of the prongs (42), and which is shown more clearly by the region within the dotted lines of FIG. 3 referred to as (43).

The anchor assist device of a preferred embodiment of the invention is shown generally as (10).

Figure 1:
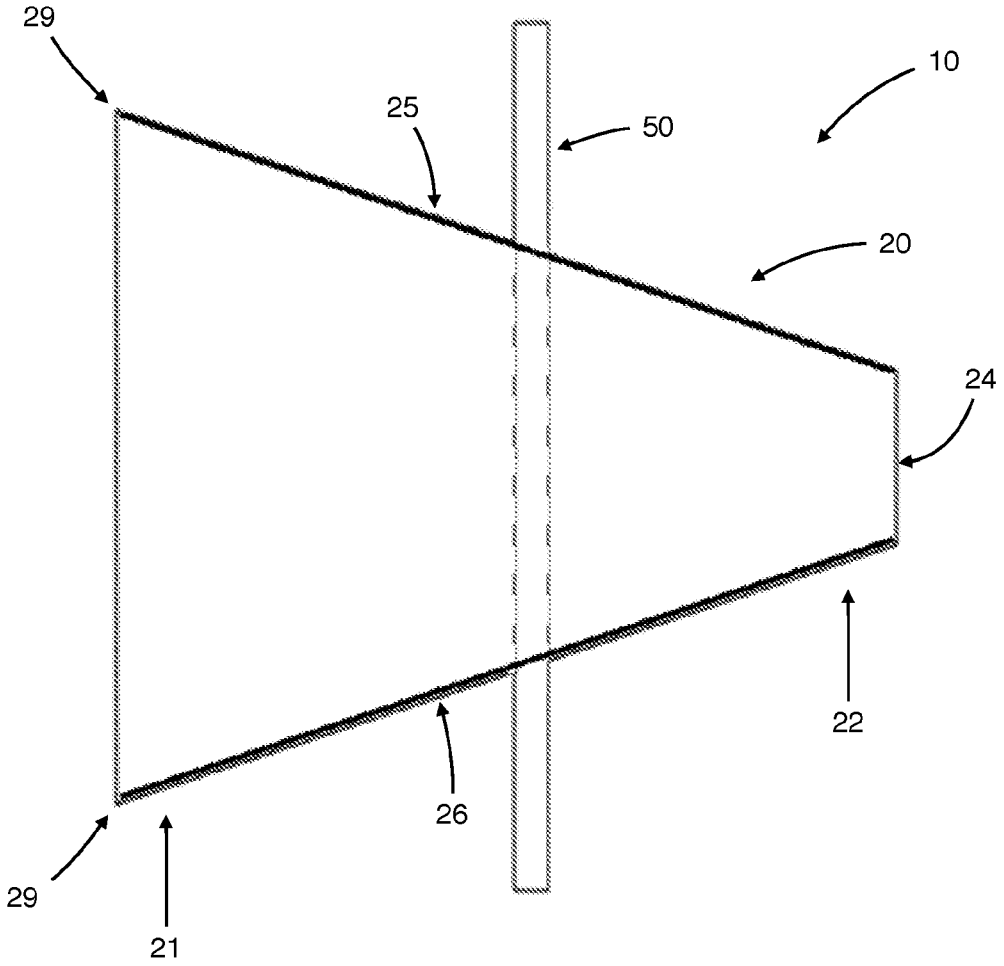
FIG. 1 is an illustration of the plate section of the anchor assist device in a preferred embodiment of the invention.

FIG. 1 shows a preferred embodiment of the anchor assist device (10) of the present invention, which includes a plate section (20) having a base end (21) located opposite to a ground-engaging end (22). As shown in FIG. 1, the plate section (20) further includes a leading edge (24), a first side (25), a second side (26) and corners (29) at the base end (21). In addition, the anchor assist device of the preferred embodiment includes a cross member (50) by which the plate section may be supported by two or more prongs (42) of the grappling anchor (40).

More particularly, as shown in FIGS. 2 and 3, the base end (21) of the plate section (20) is attached to an inner portion (43) (or lower rose portion) of the grappling anchor (40), such that the plate section (20) is supported by two or more prongs (42) of the grappling anchor (40) by way of the cross member (50), and the ground-engaging end (22) of the plate section (20) extends outwardly from the inner portion (43) of the grappling anchor (40). Advantageously, the ground-engaging end (22) of the plate section (20) is exposed such that it is able to penetrate and embed within a soft anchoring surface, such as sand, rubble, mud or shale. In particular, the increased surface area of the plate section (20), in comparison with the prongs (42) of the grappling anchor (40), provides improved anchor hold capacity when in contact with soft anchoring surfaces, which results in the anchor assist device increasing the versatility of traditional grappling anchors.

The base end (21) of the plate section (20) may be attached to the inner portion (43) of the grappling anchor (40) by any means that would be known by those skilled in the art. This may include permanent attachment through welding, or the like, to the inner portion (43) at either the lower ends (44) of the prongs (42) or at the lower end (45) of the shank (41) (not shown). When the anchor assist device (10) is permanently attached to the grappling anchor (40), the grappling anchor (40) may still be flexibly used with hard or semi-hard anchoring ground by way of free prongs (42) that are not involved in the attachment of the anchor assist device (10).

Alternatively, as shown in the preferred embodiment depicted in FIGS. 1 to 4, the base end (21) of the plate section (20) is movably coupled to the inner portion (43) of the grappling anchor (40) through the use of a coupling means, which allows the plate section (20) to be movable from a first position in which the plate section (20) is supported by two or more of the prongs (42) of the grappling anchor (40), as shown in FIGS. 2 and 3 by way of the cross member (50), to a second position away from the two or more prongs (42) of the grappling anchor (40) and towards the shank (41). This is particularly advantageous in that when the grappling anchor (40) is fitted with the anchor assist device (10) and encounters soft anchoring surfaces, the plate section (20) is in the first position and supported by two or more of the prongs (42) so that the ground-engaging end (22) may penetrate the soft anchoring surface and a portion of the plate section (20) then becomes embedded within the soft anchoring ground. Then, when encountering hard or semi-hard anchoring surfaces, the plate section (20) is movable to the second position away from the prongs (42) so that the prongs (42) may hook onto the hard or semi-hard anchoring surface in the way that they normally would when using a grappling anchor (40). Thus, the movable coupling increases the flexibility of the anchor assist device (10) and means that once attached to the grappling anchor (40), the anchor assist device (10) may remain when encountering either soft and hard or semi-hard anchoring grounds.

The coupling means may include any such means that would be known by those skilled in the art to movably couple the base end (21) of the plate section (20) to the inner portion (43) of the grappling anchor (40). More specifically, the coupling means may include one or more shackles (30) that movably couple the base end (21) of the plate section to the inner portion (43) of the grappling anchor (40), and more particularly, to the lower ends (44) of the prongs (42) within the inner portion (43). In particular, the embodiment shown in FIG. 2 includes a pair of shackles (30) that movably attach the base end (21) of the plate section (20) to the lower ends (44) of neighbouring prongs (42). However, any number and positioning of shackles (30) that would achieve the movable coupling of the plate section (20) to the inner portion (43) are considered to fall within the scope of the invention.

In addition, in the preferred embodiment depicted in FIG. 2, the shackles (30) are permanently attached to the underside (23) of the plate section (20). In this case, the shackles (30) are welded to the underside (23) at the base end (21) of the plate section (20); however, the shackles (30) may be permanently attached through any other means that would be known by those skilled in the field. The shackles (30) may be positioned approximately 10 mm from the corners (29) of the plate section (20) with the shackle opening facing away at approximately 90° to the plate section (20). However, the positioning of the shackles (30) may include any other positioning that would achieve the function of movably coupling the base end (21) of the plate section (20) to the inner portion (43) of the grappling anchor (40) and would be known by those skilled in the art.

As mentioned above, the embodiment of the anchor assist device (10) depicted in FIGS. 1 to 4, includes a cross member (50), which acts as a support bar and extends transversely across the plate section (20), overhanging the first side (25) and the second side (26) of the plate section (20). In this way, the plate section (20) is supported by neighbouring prongs (42) of the grappling anchor (40) by way of the cross member (50). Also, in the embodiment shown in FIGS. 1 to 4, the cross member (50) is attached to the underside (23) of the plate section (20). In particular, the cross member (50) may be welded to the underside of the plate section (20). Alternatively, the cross member (50) may be bolted to the underside (23) of the plate section (20) or secured by any other suitable attachment means that would be known to those skilled in the art.

The cross member may be in the form of a cylindrical (round) bar of a suitable diameter and length to overhand the sides (25, 26) of the plate section (20). As an example only, the cross member may be formed of a 10 mm round bar of 300 mm in length. The cross member (50) may be attached parallel and approximately 850 mm from the base end (21); however, any other positioning of the cross member (50) that would achieve the function of supporting the plate section (20) by two or more of the prongs (42) is considered to fall within the scope of the present invention.

As depicted in the embodiment shown in FIG. 1, the ground-engaging end (22) of the plate section (20) includes a leading edge (24) that is adapted to penetrate a soft anchoring surface/ground, such as sand, rubble, mud or shale. In particular, in the preferred embodiment shown in FIGS. 1 to 4, the ground-engaging end (22) includes one leading edge (24) that is a flattened edge. However, the ground-engaging end may include any number of leading edges (24) such that it would achieve the effect of penetrating and embedding within soft anchoring ground, as further discussed below.

Furthermore, as depicted in FIGS. 1 to 4, the plate section (20) is a flat plate and provides a surface for penetrating and embedding within soft anchoring ground. Alternatively, the plate section may be curved (bent), as discussed further below.

Additionally, the plate section (20) may be formed in any number of general shapes that would allow the ground-engaging end (22) of the plate section (20) to penetrate and embed within soft anchoring surfaces (ground). In the embodiment shown in FIGS. 1 to 4, the plate section (20) is in the form of a flat isosceles trapezoid having first and second sides (25, 26) of equal length. For example, the first and second sides (25, 26) may be 210 mm with a leading edge (24) of 25 mm; however, any other dimensions that allow the anchor assist device (10) to be attached to the grappling anchor (40) could be used. Also, as shown, the leading edge (24) is flat and has a narrower width than the base end (21) of the plate section (20). Advantageously, this wedged shape allows the ground-engaging end to embed with a soft anchoring ground to achieve improved anchor hold capacity. In addition, the ground-engaging end (22) of the plate section (20) may also be formed to include two or more leading edges (24), which whilst not shown in the Figures provided, is considered to fall within the scope of the present invention.

Figure 5:
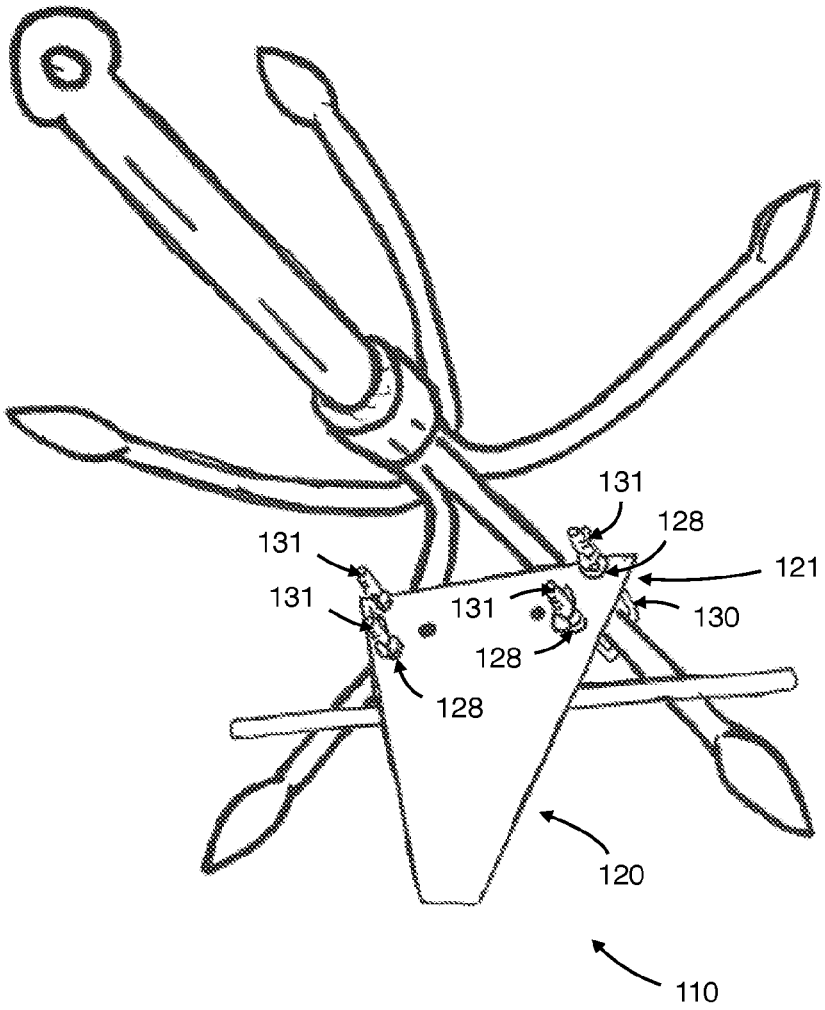
FIG. 5 is a perspective view of the anchor assist device in use with a grappling anchor in an alternative preferred embodiment of the present invention.
Figure 6:
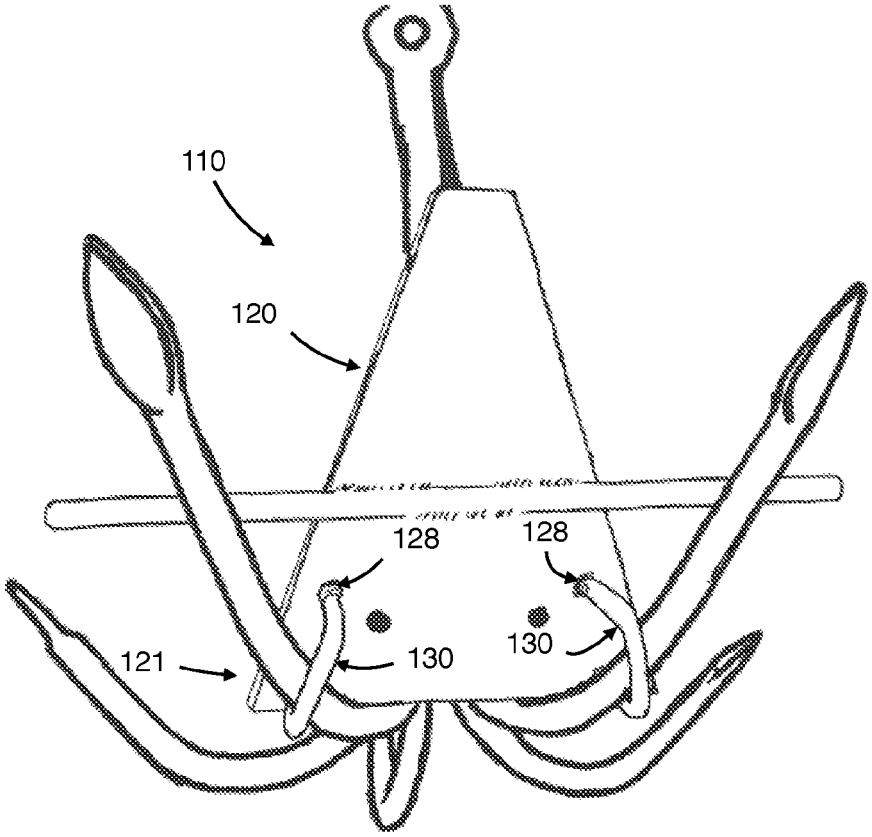
FIG. 6 is a perspective view of the anchor assist device in use with a grappling anchor in an alternative preferred embodiment of the present invention.

In an alternative embodiment of the anchor assist device (110), the shackles (130) may be removably attached to the plate section (120) by any such means known to those skilled in the field. In particular, the anchor assist device (110), as shown in FIGS. 5 and 6, includes square ended shackles (130) that are positioned through corresponding holes (128) formed through the base end (121) of the plate section (120). The shackles (130) are then held in place with the use of butterfly nuts (131) and sprung washers, or the like, and may be removed when desired. The corresponding holes (128) through the base end (121) of the plate section (120) may be formed by any means known by those skilled in the art, including through drilling, laser cutting or punching.

More particularly, a number of different types of shackles of suitable sizes may be utilised, including but not limited to 'D' shackles. As shown in FIG. 2, the shackles may include two 20 mm 'D' Shackles placed at 90° to the plate section (20) (wedge) and 70° with respect to the corner sections (29). Each 'D' Shackle is set an appropriate distance (approximately 10 mm) in from the corners (29). The opening section of each shackle is uppermost with the thread section facing outwardly. Alternatively, square "U" shackles, as depicted in FIGS. 5 and 6 may be utilised. For examples holes that allow for use of square 'U' shackles with 5/16 thread (L: 64 mm, W: 34 mm, T: 40 mm).

As mentioned above, the plate section and leading edge may also take the form of any number of other shapes and configurations to assist with increasing the surface area and anchor hold capacity of the anchor assist device when used for soft anchoring ground. FIGS. 7*a* to 7*e* illustrate various examples in which the plate section is curved/bent. However, these examples are not exhaustive and it is considered that other forms of the plate section having alternative curved or flat portions fall within the scope of the present invention.

Figure 7A:
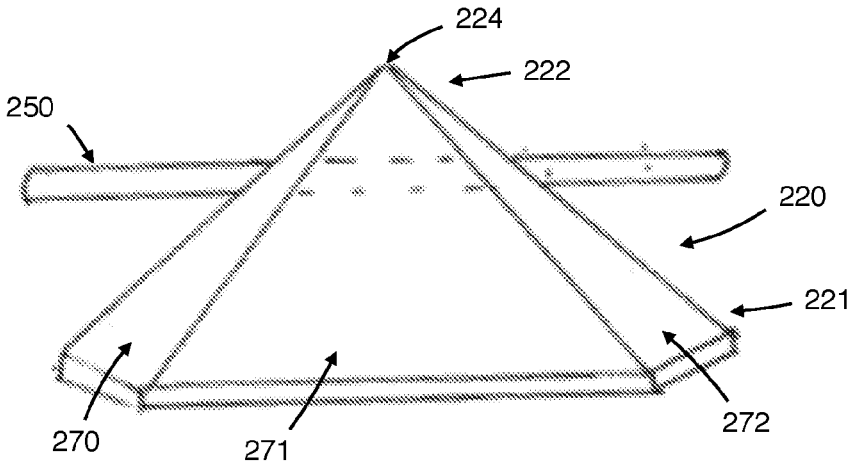
FIGS. 7*a* to 7*e* are a series of perspective views of the plate section of the anchor assist device according to further alternative preferred embodiments of the present invention.
Figure 7B:
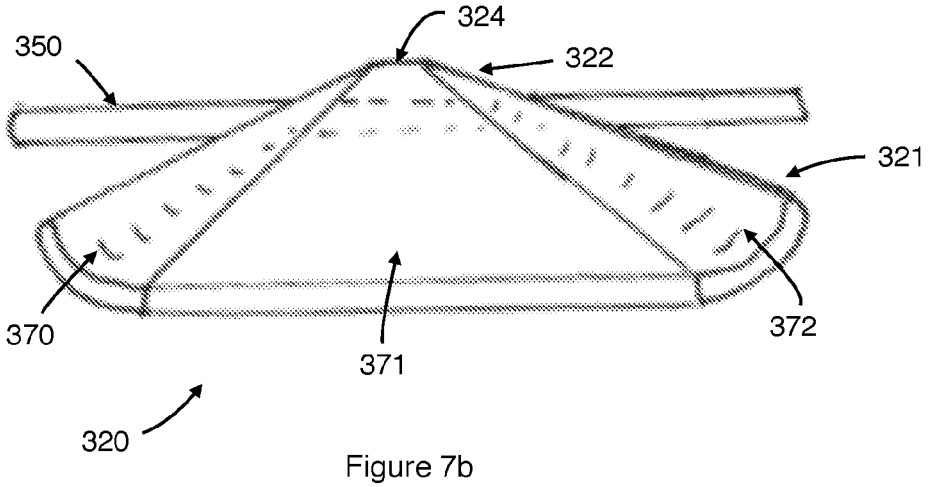
Figure 7C:
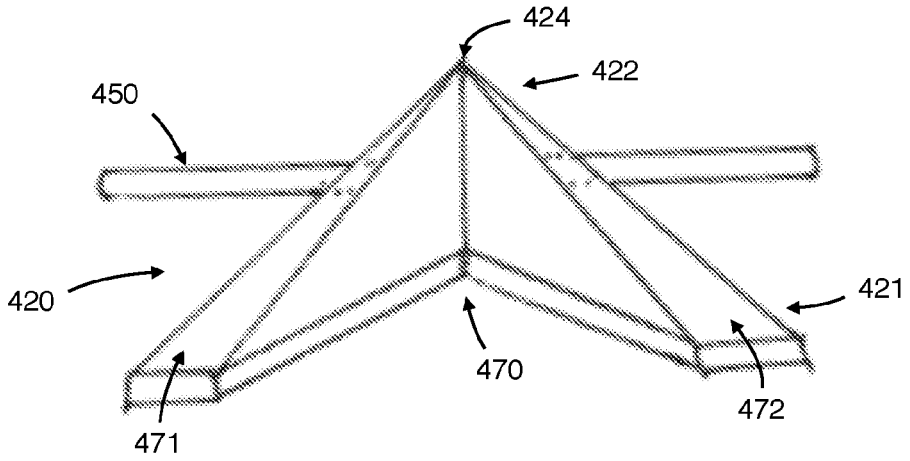
Figure 7D:
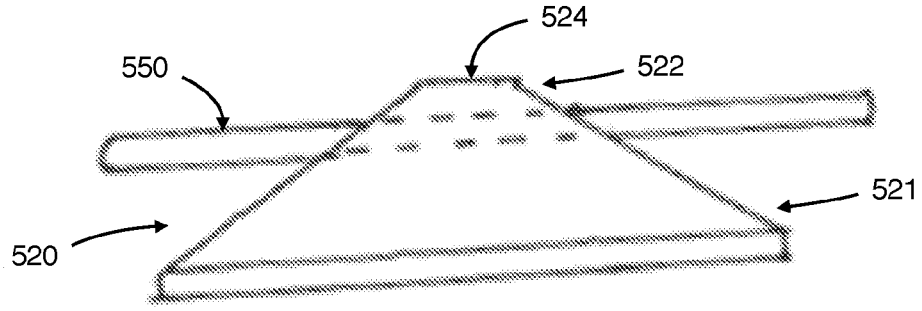
Figure 7E:
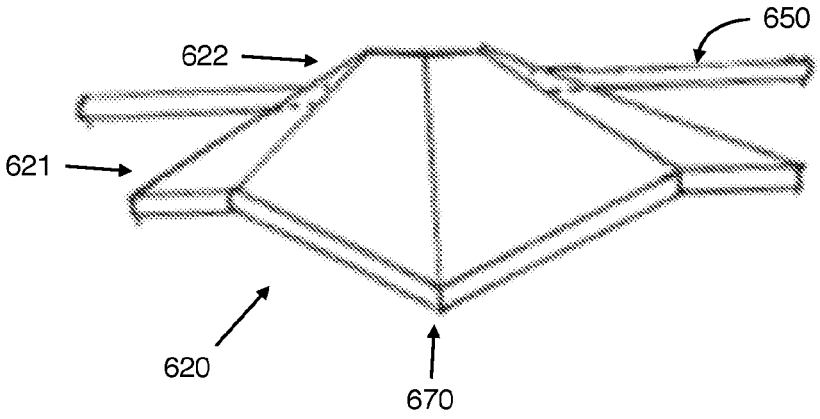

In the embodiment depicted in FIG. 7*a*, the plate section (220) is curved to form three distinct regions (270, 271, 272), which then narrow and come together towards the ground engaging end (222) so that the leading edge (224) is in the form of a pointed end. The plate section (220) is then able to be supported by the prongs of the grappling anchor (not shown) by way of the cross member (250). Alternatively, as shown in FIG. 5*b*, the plate section (320) may be curved to form three distinct regions (370, 371, 372) wherein the outer regions (370, 372) curve upwardly and the leading edge (324) of the ground-engaging end (322) is a narrow, flattened edge. The plate section (320) is then able to be supported by the prongs of the grappling anchor (not shown) by way of the cross member (350).

Another embodiment of the plate section (420) is shown in FIG. 5*c* in which the plate section (420) is bent to form a central raised portion (470) and two flat side portions (471, 472). The portions (470, 471, 472) converge from the base end (421) towards the ground-engaging end (422) to form a pointed leading edge (424). The plate section (420) is then able to be supported by the prongs of the grappling anchor (not shown) by way of the cross member (450).

The embodiment depicted in FIG. 5*d* mirrors that of FIGS. 1 to 4, wherein the plate section (520) is a flat plate with a base end (521), a ground-engaging end (522) and a flattened leading edge (524). The plate section (520) is then able to be supported by the prongs of the grappling anchor (not shown) by way of the cross member (550).

As shown in FIG. 5*e*, the plate section (620) includes the base end (621), ground-engaging end (622) and may be bent to form a central depressed portion (670), wherein the leading edge (624) is a flattened curved leading edge. The plate section (620) is then able to be supported by the prongs of the grappling anchor (not shown) by way of the cross member (650).

Figure 8:
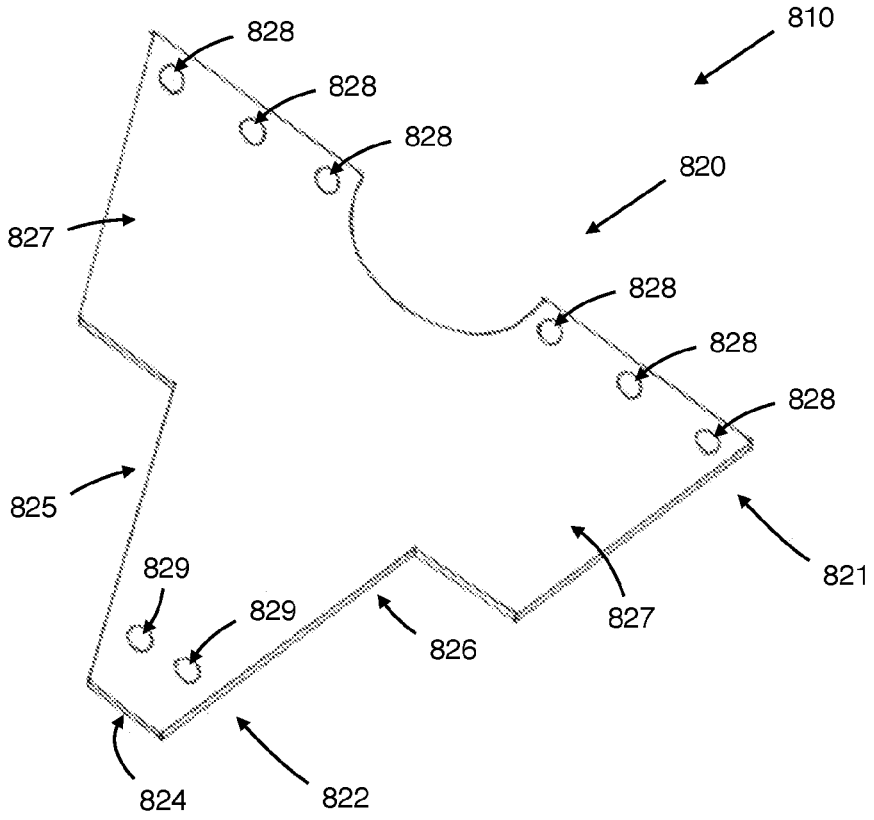
FIG. 8 is a top view of an alternative embodiment of the plate section of the anchor assist device according to the present invention.

In another embodiment of the invention, the anchor assist device (810) includes extension pieces, wherein the plate section (820) is supported by the one or more prongs of the grappling anchor by way of the extension pieces. This is depicted in FIG. 8, wherein the plate section (820) includes extension pieces (827) that project outwardly from the first and second sides (825, 826) of the plate section (820), respectively, such that the extension pieces (827) are supported by neighbouring prongs (842) of the grappling anchor (840). In this embodiment the cross member (50) is not required as the extension pieces (827) provide a surface that rests on the prongs of the grappling anchor in order to support the plate section (820). The extension pieces (827) may be integrally formed with the plate section (820), as shown in FIG. 8, or may be individual pieces that are attached to the plate section (820).

Also, as shown in FIG. 8, the plate section (820) may optionally include a plurality of openings or holes (828) at the base end (821) through which shackles or other attachment means may be received. In addition, further openings or holes (829) may also be formed at the ground engaging end (822) of the plate section (820) to allow for additional attachment means to be utilised, such as zip ties (cable ties) or the like.

Figure 9:
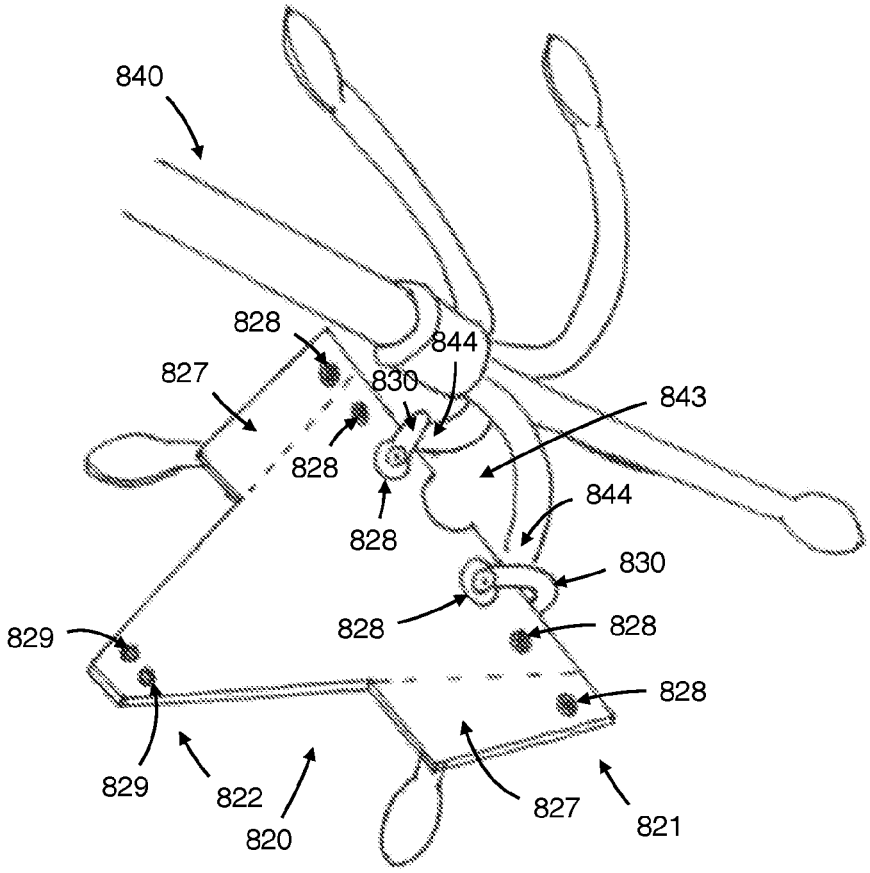
FIG. 9 is a perspective view of the anchor assist device of FIG. 8 in use with a grappling anchor in an alternative preferred embodiment of the present invention.

FIG. 9 shows the plate section (820) as illustrated in FIG. 8 when attached to the inner portion (843) of a grappling anchor (840). In particular, the plate section (820) is attached to lower ends (844) of neighbouring prongs (842) by way of a pair of shackles (830) inserted through two of the openings (828). However, as discussed above, any other suitable attachment means may be used. As shown, the extension pieces (827) are supported by neighbouring prongs (842) of the grappling anchor (840), such that the ground-engaging end (822) extends outwardly from the inner portion (843) of the grappling anchor (840). Also, the leading edge (824) of the plate section (820) is oriented outwardly from the inner portion (843) of the grappling anchor (840) so that it may penetrate and embed within a soft anchoring ground.

Figure 10:
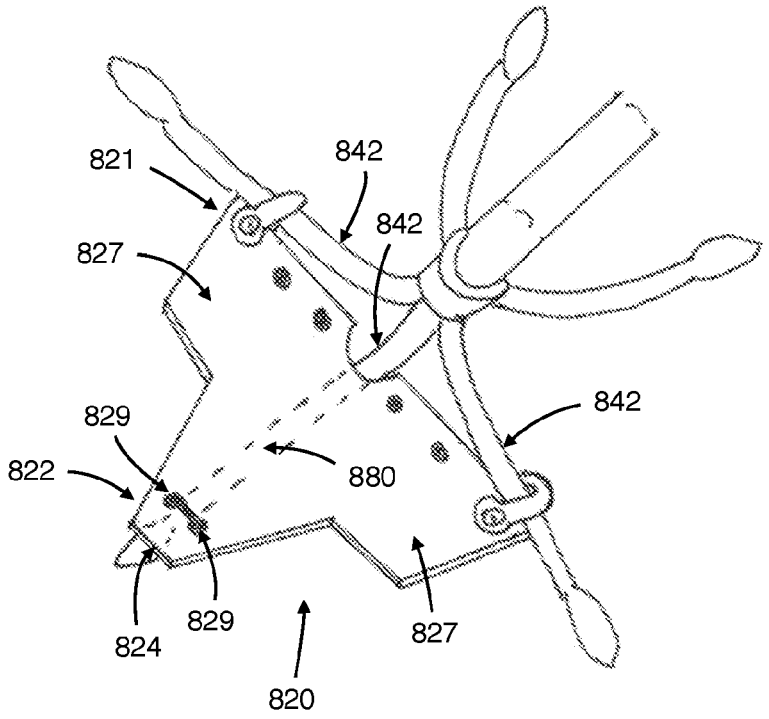
FIG. 10 is a perspective view of the anchor assist device of FIG. 8 in use with a grappling anchor in an alternative preferred embodiment of the present invention.

FIG. 10 depicts an alternative attachment arrangement of the anchor assist device (810) depicted in FIG. 8, whereby the plate section (820) is attached to two prongs (842) at the inner portion (843) of a grappling anchor (840), and wherein a central part (880) of the plate section (820) rests along and is supported by a prong (842) of the grappling anchor (840). As shown, the ground-engaging end (822) and leading edge (824) extend outwardly from the inner portion (843) such that the plate section (820) is able to penetrate and embed within a soft anchoring ground or surface. The ground-engaging end (822) of the plate section (820) may be optionally secured to the prong (842) by way of a zip tie (cable tie) passing through corresponding holes (829) on the plate section (820). Therefore, whilst the shackles (830) remain the main attachment means, zip ties or the like may be used as complementary securing means to reduce rattle and to aid in centring the plate section (820) along the third prong (842). Other complementary securing means that would be known by those skilled in the art are considered to fall within the scope of the present invention.

Figure 11:
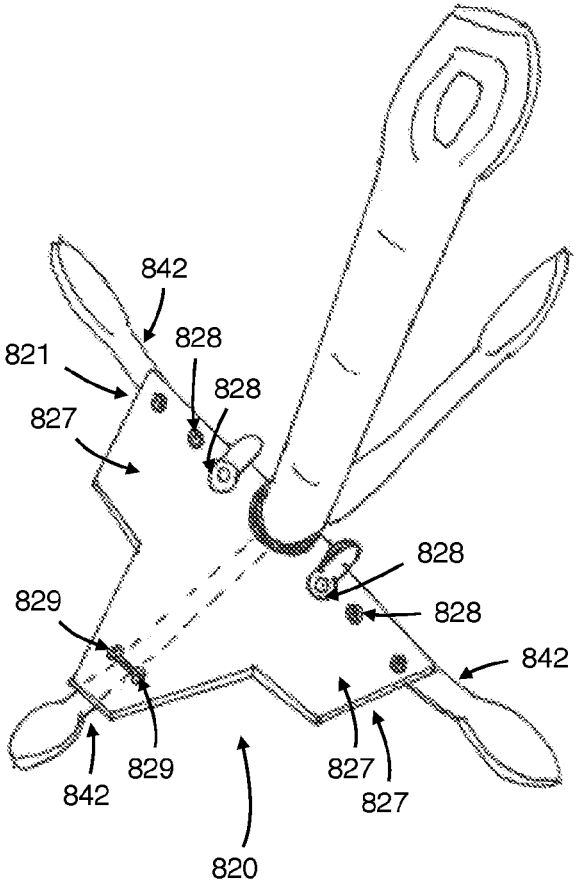
FIG. 11 is a perspective view of the anchor assist device of FIG. 8 in use with a grappling anchor in an alternative preferred embodiment of the present invention.

FIG. 11 illustrates a similar arrangement to that depicted in FIG. 10; however, the grappling anchor (840) has four prongs (842) rather than five as shown in FIG. 10. As shown, the position of the attachment means (shackles) may vary as desired by virtue of the placement of the openings (828) at the base end (821) of the plate section (820).

Figure 12:
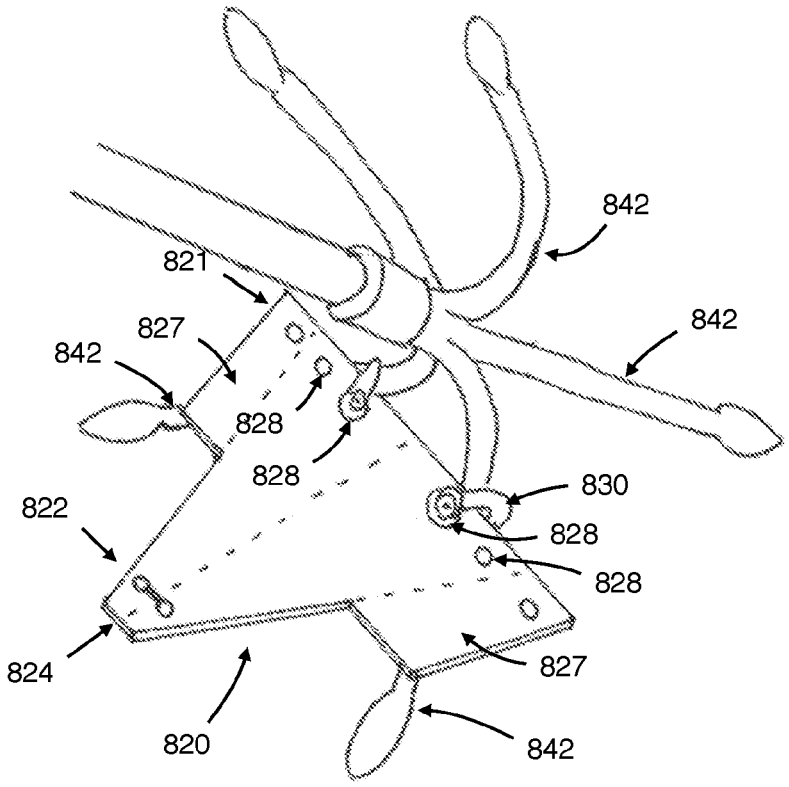
FIG. 12 is a perspective view of an alternative embodiment of the anchor assist device in use with a grappling anchor in an alternative preferred embodiment of the present invention.
Figure 13:
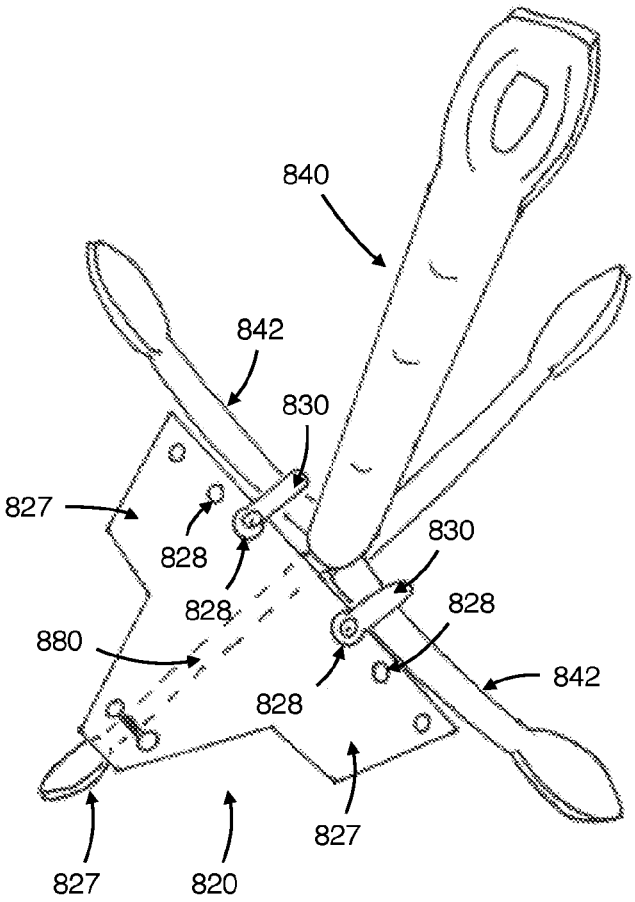
FIG. 13 is a perspective view of an alternative embodiment of the anchor assist device in use with a grappling anchor in an alternative preferred embodiment of the present invention.
Figure 14:
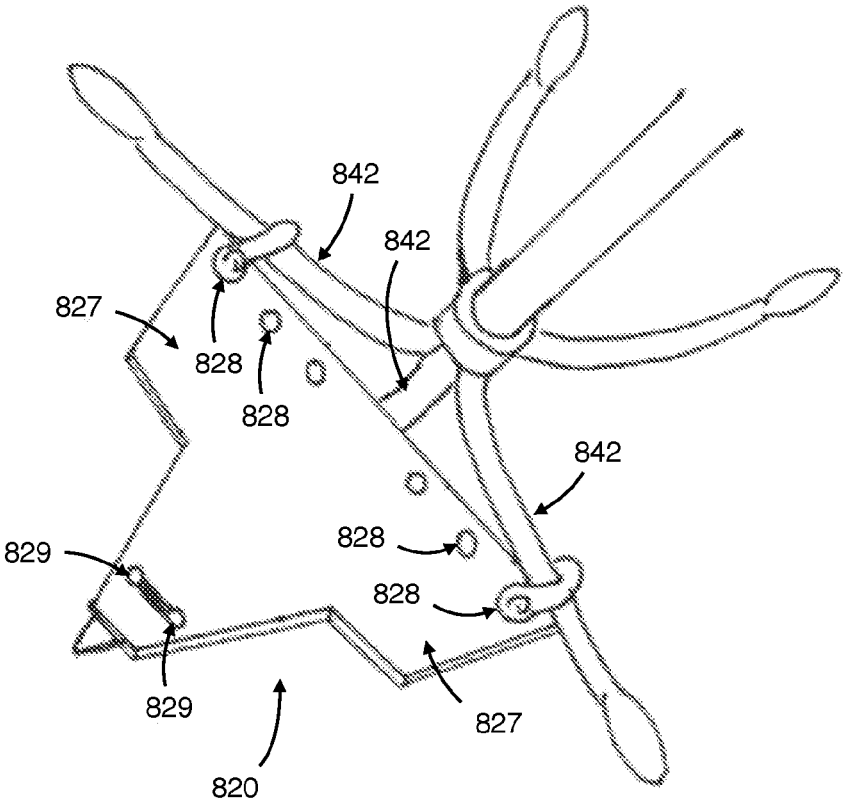
FIG. 14 is a perspective view of an alternative embodiment of the anchor assist device in use with a grappling anchor in an alternative preferred embodiment of the present invention.

FIGS. 12 to 14 include further examples of how the plate section (820) may be attached to various grappling anchors (840) by way of the positioning of the openings (828) at the base end (821) of the plate section (820). As discussed earlier, the plate section (820) may be in the form of a variety of shapes and configurations, including flat, curved, bent, concave, etc.

The plate section (20) (or wedge) and other components of the present invention, including shackles, cross member, extension pieces, etc., may be made from mild steel, stainless steel, galvanised steel or any other suitable materials that would be known by those skilled in the art. This may include materials of various thicknesses that achieve the desired functionality. In addition, the thickness of the plate section may be varied as desired. For example the thickness of the plate section may be approximately 3 mm, however, it is not limited to this thickness and could be thicker or thinner as desired, so that it achieves the desired effect of being able to penetrate and embed within a soft anchoring ground.

The illustrations offered by way of example shows the invention with dimensions that are suitable for use on domestic grapnel, grappling or reef anchors as used on small to medium vessels or boats. However, the design may be enlarged by all factors to accommodate application with such as larger vessels, boats or ships.

As shown in FIG. 4, when in use the base end (21) of the anchor assist device (10) may be attached to the inner portion (43) of a grappling anchor (40) such that the plate section is supported by the prongs (42) of the grappling anchor (40) and the ground-engaging end (22) extends outwardly from the inner portion (43). The arrow (60) depicts the direction of travel when setting the grappling anchor (40) and the arrow (61) depicts the direction of embedment of the ground-engaging end (22) of the plate section (20) within the soft anchoring ground (not shown).

Overall, the anchor assist device as disclosed and when attached to a parenting grappling, grapnel, or reef anchor provides a plate section with a ground-engaging end (wedge surface) that will dig into and provide increased drag embedment and anchor hold capacity within soft anchoring ground (loose seabed), such as loose gravels, shale, sand or/or mud.

Advantageously, the anchor assist device of the invention is quick and easy to fit (attach) to a grappling anchor and once fitted will provide a wide friction hold area increasing the anchor hold capacity and the stability of the vessel at anchor when used for soft anchoring grounds, such as loose gravels, shale, sand or mud.

Furthermore, in one form of the invention the anchor assist device (10) may be shackled to and removed from the grappling anchor (40) with relative ease. However, the anchor assist device (10) may also stay affixed and will have minimal impact on the parenting grapnel, grappling or reef type anchors' hold capacity when used on underwater anchoring grounds of reef or rock. In particular, if used on underwater hard anchoring grounds, such as reef or rock, the anchor assist device (10) will either hold in place or will rotate away enabling the prongs (42) of the grappling anchor (40) to secure to the anchoring ground.

It will be appreciated that many modifications and variations may be made to the methods of the invention described herein without departing from the spirit and scope of the invention.

The descriptions, illustrations, photographs and drawings, form the disclosure of this specification all of which are imported hereinto as part of the record hereof. It is to be understood that various alterations, modifications and/or additions may be incorporated into the various constructions and arrangements or parts without departing from the spirit and ambit of the invention.

1. An anchor assist attachment/device for use on a parenting Grapnel, Grappling and Reef anchors, comprising:

a. A flat plate section (isosceles triangle/trapezoide) with two equal long and one short side with the tip section presenting as a flattened point.

b. Cross member/bar section welded across the rear mid-section of the plate/wedge section crossing and extending past the two equal long edges of the plate section c. Two securing shackles welded to the rear flat section of the plate/wedge at each corner (long & short side of the plate triangle) at 70° to the respective corner sections.

2. An anchoring assist attachment/device according to claim 1, for use with and attachment to grapnel, grappling and/or reef anchors increasing embedment and hold capacity on a sand or soil below a seabed or riverbed surface.

3. An anchoring assist attachment/device according to claims 1 and 2, comprising of a flat wedge surface that is attached by two shackles to the lower rose portion (inner portion) of a selected parenting anchor (grappling anchor).

4. An anchoring assist attachment/device according to claims 1 to 3, on attachment and use stability and load retention is provided through a cross member/bar section that is welded to the rear surface (underside) of the wedge section. This cross member/bar section resting against the inner section (inner portion) of the selected anchor with the left and right side of this cross member/bar section resting on the left and right neighbouring prongs of the selected anchor.

5. An anchoring assist attachment/device according to claims 1 to 4, once attached and in use providing an increased embedded anchoring surface when used on lose marine and/or river bed surfaces, including sand & soil, increasing embed surface hold area of the anchor by up to and exceeding 500% as assessed against the available friction surface offered by the parenting anchor.

6. An anchoring assist attachment/device according to claims 1 to 5, flat wedge section being triangle (isosceles) in shape with cross member/bar. Narrow flat edge of the triangle wedge section sitting on the inner section of the anchor rose providing point of stability.

7. An anchoring assist attachment/device according to claims 1 to 6, flat wedge section being triangle (isosceles) in shape with long side edges of equal length gradually reducing to a flattened point section this section being forward facing enabling ease of embedment to ground surface.

8. An anchoring assist attachment/device according to claims 1 to 7, that once fitted and in use will provide sufficient weight to the parenting anchor (grappling anchor) allowing the wedge flattened point/section to predominantly be the first area of the anchor that comes into contact with and embeds to the anchoring surface.

9. An anchoring assist attachment/device according to claims 1 to 9, if used on marine or river beds with broken or solid rock or reef ground the anchor if not held by the wedge section will rotate (move) and hold by the parenting anchors' (grappling anchors') own prong sections.

10. An anchoring assist attachment/device according to claims 1 to 9, the wedge section (plate section) having a load bearing surface which bears on said loose sand or soil when said anchor is subjected to loading therein. When anchoring presents an angled anchor to the ground surface.

11. An anchoring assist attachment/device according to claims 1 to 10, is able to be attached and removed for storage and/or replaced with ease by fastening or unfastening securing shackles.

12. An anchoring assist attachment/device according to claims 1 to 11, when deployed and running against the ground surface will present at or about the same angle as the parenting anchors prongs.

13. An anchoring assist attachment/device according to any proceeding claim that may be affixed by either use of 'd' shackles welded to the plate section; or by secondary means, through placement of square 'u' shackles through holes placed in the plate section.

14. An anchoring assist attachment/device according to claim 13, that may be supported by a cross member/bar section that is either welded or bolted in place.

15. An anchoring assist attachment/device according to claims 1 to 14, that may be enlarged by all factors to accommodate application with such as larger vessels, boats and/or ships.

The invention claimed is:

1. An anchor assist device when used with a grappling anchor, the grappling anchor including a shank, three or more prongs extending outwardly from a lower end of the shank, and an inner portion defined by the lower end of the shank and corresponding lower ends of each of the prongs, the anchor assist device including:

a plate section having a base end and an opposing ground-engaging end;

wherein the base end of the plate section is attached to the inner portion of the grappling anchor, such that the plate section is supported by two or more prongs of the grappling anchor, and the ground-engaging end of the plate section extends outwardly from the inner portion of the grappling anchor.

2. The anchor assist device according to claim 1, wherein the base end of the plate section is welded to the inner portion of the grappling anchor.

3. The anchor assist device according to claim 1, wherein the base end of the plate section is movably coupled to the inner portion of the grappling anchor by way of a coupling means, such that the plate section is able to move from a first position in which the plate section is supported by two or more of the prongs of the grappling anchor to a second position away from the two or more prongs of the grappling anchor.

4. The anchor assist device according to claim 3, wherein the coupling means includes one or more shackles that movably couple the plate section to the lower ends of two or more prongs of the grappling anchor.

5. The anchor assist device according to claim 4, wherein the base end of the plate section is movably coupled to the lower ends of a pair of prongs of the grappling anchor by a pair of shackles.

6. The anchor assist device according to claim 4, wherein the shackles are permanently attached to an underside of the plate section.

7. The anchor assist device according to claim 4, wherein the shackles are welded to the underside of the plate section.

8. The anchor assist device according to claim 4, wherein the shackles are removably attached to the underside of the plate section.

9. The anchor assist device according to claim 8, wherein the shackles are positioned through corresponding holes formed through the base end of the plate section and secured with a plurality of nuts.

10. The anchor assist device according to claim 1, wherein the ground-engaging end of the plate section includes one or more leading edges adapted to penetrate a soft anchoring surface.

11. The anchor assist device according to claim 10, wherein the one or more leading edges is a flattened edge.

12. The anchor assist device according to claim 10, wherein the one or more leading edge is a pointed end.

13. The anchor assist device according to claim 1, wherein the plate section is flat.

14. The anchor assist device according to claim 1, wherein the plate section is curved or bent.

15. The anchor assist device according to claim 1, wherein the plate section is an isosceles trapezoid having a pair of sides of equal length, and wherein the leading edge is flat and has a narrower width than the base end of the plate section.

16. The anchor assist device according to claim 1, wherein the anchor assist device further includes a cross member that extends transversely across the plate section and overhangs a first side and a second side of the plate section, such that the cross member may be supported by neighbouring prongs of the grappling anchor.

17. The anchor assist device according to claim 16, wherein the cross member is attached to an underside of the plate section.

18. The anchor assist device according to claim 16, wherein the cross member is welded to an underside of the plate section.

19. The anchor assist device according to claim 16, wherein the cross member is bolted to an underside the plate section.

20. The anchor assist device according to claim 1, wherein the plate section further includes one or more extension pieces that project outwardly from a first side and a second side of the plate section, such that the extension pieces may be supported by neighbouring prongs of the grappling anchor.

* * * * *